US006294993B1

(12) United States Patent
Calaman

(10) Patent No.: US 6,294,993 B1
(45) Date of Patent: Sep. 25, 2001

(54) SYSTEM FOR PROVIDING PERSONAL SECURITY VIA EVENT DETECTION

(76) Inventor: Gregory A. Calaman, 21 Cleverdon Rd., Ho-Ho-Kus, NJ (US) 07423

( * ) Notice: Subject to any disclaimer, the term of this patent is extended or adjusted under 35 U.S.C. 154(b) by 0 days.

(21) Appl. No.: 09/347,575

(22) Filed: Jul. 6, 1999

(51) Int. Cl.[7] ..... G08B 1/08

(52) U.S. Cl. ..... 340/539; 340/531; 340/573; 340/573.1; 340/825.36; 340/825.49

(58) Field of Search ..... 340/539, 573, 340/573.1, 573.4, 825.36, 825.49, 531

(56) References Cited

U.S. PATENT DOCUMENTS

| | | | | |
|---|---|---|---|---|
| D. 357,741 | | 4/1995 | Magnus | D24/167 X |
| 3,949,388 | | 4/1976 | Fuller | 340/189 |
| 4,952,928 | * | 8/1990 | Carroll et al. | 340/825.54 |
| 5,228,449 | * | 7/1993 | Christ et al. | 128/691 |
| 5,471,983 | | 12/1995 | Magnus | 128/644 |
| 5,528,248 | * | 6/1996 | Steiner et al. | 342/357 |
| 5,628,324 | | 5/1997 | Sarbach | 128/670 |
| 5,634,468 | | 6/1997 | Platt et al. | 128/696 |
| 5,742,233 | | 4/1998 | Hoffman et al. | 340/573 |
| 5,748,148 | | 5/1998 | Heiser et al. | 342/457 |
| 5,782,778 | | 7/1998 | De Briere et al. | 600/587 |
| 5,797,091 | * | 8/1998 | Clise et al. | 455/404 |
| 5,835,907 | * | 11/1998 | Newman | 340/825.49 |
| 5,838,237 | | 11/1998 | Revell et al. | 340/573 |
| 5,855,609 | | 1/1999 | Knapp | 623/11 |
| 5,862,803 | | 1/1999 | Besson et al. | 128/696 |
| 5,871,508 | | 2/1999 | Thompson et al. | 607/9 |
| 5,877,675 | | 3/1999 | Rebstock et al. | 340/286.07 |
| 5,900,817 | | 5/1999 | Olmassakian | 340/573.1 |
| 5,959,529 | * | 9/1999 | Kai, IV | 340/539 |
| 5,986,540 | * | 11/1999 | Nakagaki et al. | 340/384.7 |
| 6,028,514 | * | 2/2000 | Lemelson et al. | 340/539 |
| 6,032,036 | * | 2/2000 | Maystre et al. | 455/404 |
| 6,045,513 | * | 4/2000 | Stone et al. | 600/508 |
| 6,072,396 | * | 6/2000 | Gaukel | 340/573.4 |
| 6,084,510 | * | 7/2000 | Lemelson et al. | 340/539 |

* cited by examiner

*Primary Examiner*—Jeffery Hofsass
*Assistant Examiner*—Hung Nguyen
(74) *Attorney, Agent, or Firm*—Michael H. Jacobs; Milbank, Tweed, Hadley & McCloy LLP

(57) ABSTRACT

An apparatus, method, and data structure for providing personal security, including a sophisticated system of component technologies designed to provide automatic detection and communication of its wearer's distress to appropriate emergency help regardless of the user's location on Earth. The device will appear to be a piece of attractive, though inexpensive jewelry. For those situations where the user is either the subject of the distress situation but has the luxury of time and wherewithal to explicitly initiate the process, or where the user is a witness to a non-user's personal distress situation, the system will also allow its user to manually initiate the distress resolution process through manipulation of a four-button sequence. The inverse will also be true—the user will be able to manipulate a different four-button sequence to cancel a distress resolution process in progress. Analogous to an insurance policy, the apparatus will provide "automatic coverage" for the situations and at the times that the user least expects to need it.

31 Claims, 5 Drawing Sheets

SYSTEM FOR PROVIDING PERSONAL SECURITY VIA EVENT DETECTION

BACKGROUND OF THE INVENTION

The invention relates in general to an apparatus, method, and data structure for providing personal security via event detection, including automatic generation of an emergency signal based on an emergency event. More particularly, the invention relates to an apparatus, method, and data structure for facilitating communications between an event-detecting device and an emergency services provider, and other various features.

A universal problem encountered by every individual on Earth at some point in his or her life is a personal distress situation. Personal distress situations can result from violent crimes, medical emergencies, or accidents—sport, automobile, work, etc. In many instances, there is no clear means of resolution for the victim—he or she is physically immobilized (such as with a heart attack) or circumstantially immobilized (such as with a robbery with a gun to the victim's head). Even if the victim has taken it upon him or herself to carry something for security purposes, e.g., cell phone, firearm, personal siren, the security product the victim has chosen is unlikely to be useful for the particular event. In these situations, help may never come, or it may arrive too late. In the United States alone, over 1.5 million deaths occur every year resulting from the three major categories of personal distress situations. It is believed that most of these deaths could have been prevented if appropriate help could have been summoned to the victim in a timely manner.

Numerous personal security aids are available, e.g., cell phones, guns, Mace, home security systems, bedside phone dialers, automobile assistance systems. However, without exception, each of the available products is limited by a common characteristic—the product does not provide automatic resolution in every situation. Many other limitations are inherent to the products depending on the type of product. For instance, a can of Mace may be a great way to stop a rapist in a parking lot, but it has no value to a heart attack victim in his office; a cell phone works well for calling an ambulance when a victim breaks a leg crossing an icy street in a city, but it probably cannot assist rescuers in locating a victim buried in an avalanche. Furthermore, each product differs in packaging, transportation medium, legality, and usefulness.

However, in general, each product is designed to resolve only a single type of unfavorable situation and is largely useless for other types. Moreover, each product has other inherent limitations posed by geography or sociopolitical factors. The following table characterizes the problems with the current solutions in three different types of unfavorable situations.

| | Medical Emergency | Violent Personal Crime | Accident |
|---|---|---|---|
| Firearm | No resolution. | Does not call for help.<br>No idea of location.<br>Not automatic.<br>Requires expertise to operate effectively. | No resolution. |

-continued

| | Medical Emergency | Violent Personal Crime | Accident |
|---|---|---|---|
| | | May escalate rether than resolve.<br>Does not convey anything about victim's condition. | |
| Chemical Spray | No resolution. | Does not call for help.<br>No idea of location.<br>Not automatic.<br>May escalate rather than resolve.<br>Does not convey anything about victim's condition. | No resolution. |
| Cell Phone | Does not work everywhere.<br>May not convey location.<br>Not automatic.<br>Does not convey anything about victim's condition. | Does not work everywhere.<br>May not convey location.<br>Not automatic.<br>May escalate rather than resolve.<br>May be unsafe to use in this situation. | Does not work everywhere.<br>May not convey location.<br>Not automatic.<br>Does not convey anything about victim's conditions. |
| Home Security System | Only protects victim when victim is home. | Only protects victim when victim is home. | Only Protects victim when victim is home. |
| Automobile Security System | No resolution. | Protects the car, not the victim.<br>Panic feature only alerts potential help within earshot.<br>No automatic resolution. | No resolution. |
| Automobile Assistance System (e.g., OnStar) | Only useful if victim is in the vehicle.<br>Does not work everywhere.<br>May not convey location.<br>Not automatic.<br>Does not convey anything about victim's condition. | Does not work everywhere.<br>May not convey location.<br>Not automatic. | Only useful if victim is in the vehicle.<br>Does not work everywhere.<br>May not convey location.<br>Not automatic.<br>Does not convey anything about victim's condition. |
| Child Screamer Device | No resolution. | Only works if child is still in range of parent's device. | No resolution. |

What is missing is a universally applicable personal security solution. Three important factors suggest that the time is right for such a universal security solution: (1) the maturation of the Baby Boomer generation in the United States and elsewhere and the physical insecurity that comes with aging; (2) the increasing susceptibility of global citizens to random violence and the public fear of experiencing such violence; and (3) the expanding interest in "image" sports and outdoor recreational activities like skiing, hiking, mountain climbing, and hang gliding.

The foregoing demonstrates that there is a need for an invention which is universally applicable in variety of distinct personal distress situations.

SUMMARY OF THE INVENTION

The invention satisfies the need and avoids the drawbacks of the prior art by providing an apparatus, method, and data structure for providing personal security via event detection. In one embodiment, personal security is provided by automatic generation of an emergency message in response to an emergency event. This emergency message may be then transmitted to an emergency services provider.

According to one aspect of the invention, an apparatus and method capable of automatically sensing a user's distress and distress type, identifying the user's spatial location, and communicating with local emergency management services to summon help to the victim are set forth. The apparatus and method may include the structure for and steps of sensing an emergency event, detecting a geographic location of the emergency event, generating an emergency message based on the emergency event and the geographic location, communicating the emergency message to an emergency services provider, and powering the requisite structures. The system may also contain the structure for and steps of providing a feedback signal to the user, allowing the user to manually generate an emergency message, and allowing transmission of the user's medical information, or any combination of these features. In addition, the emergency message may be generated in a variety of languages, and most preferably in the official language in the user's geographic location.

In another aspect of the invention, a system for providing personal security to an individual contains a computer-readable memory for storing data for access by an application program and includes a data structure stored in the computer-readable memory. The data structure may include information used by the application program and may contain an emergency event field having information associated with the presence or absence of an emergency event, a physiological feedback field, a distress rules processing field for processing the physiological feedback field, a geographic positioning field for identifying the location of the individual, and a distress message management field for generating an emergency message corresponding to an emergency event. The data structure may also contain a voice processing field for converting the emergency message into a voice message, a power management field for controlling power to the system, a heat flash indicator field for providing a feedback signal to the individual, a networking field for downloading updated information from an external computer, and a configuration update field authenticating the updated information.

DETAILED DESCRIPTION OF THE INVENTION

Figure 1:
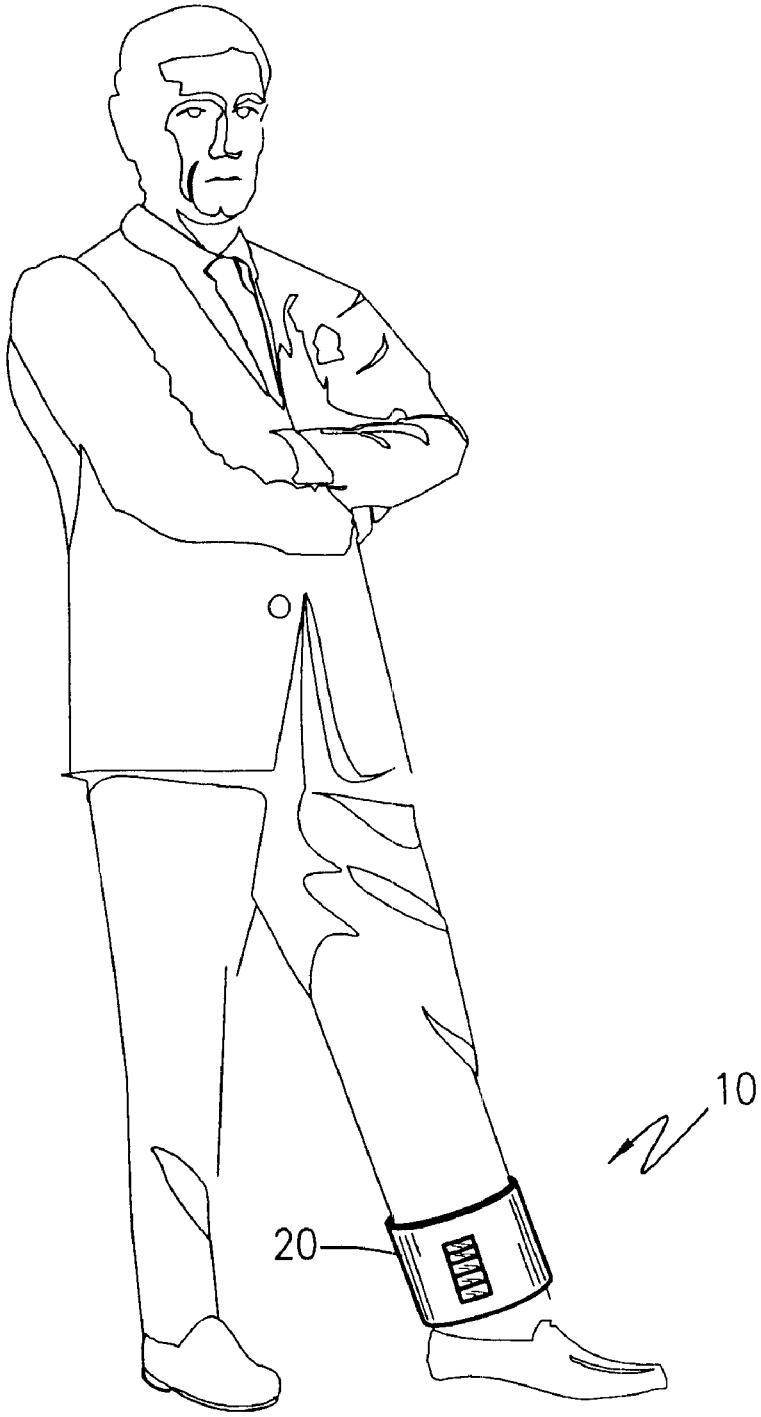
FIG. 1 illustrates a personal security system worn by an individual for a preferred embodiment of the invention.
Figure 2A:
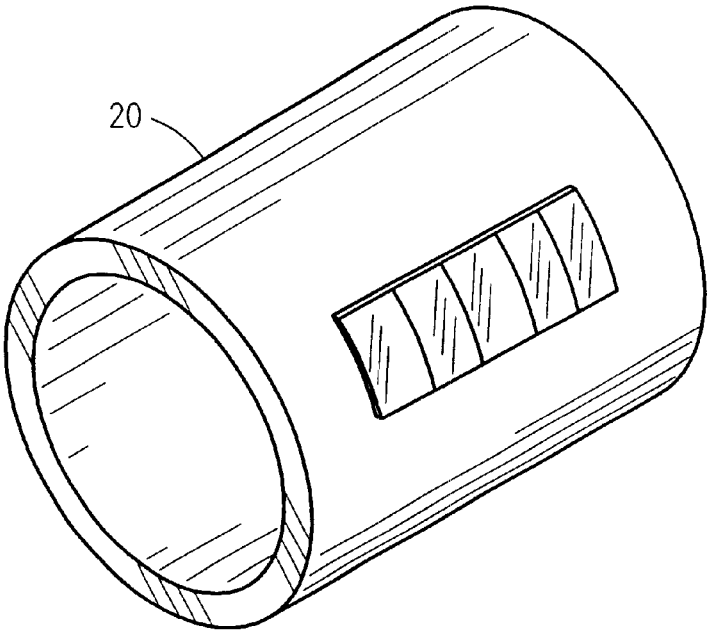
FIGS. 2A and 2B illustrate a side view and a cutaway view of the preferred embodiment of the personal security system of the invention shown in FIG. 1.
Figure 2B:
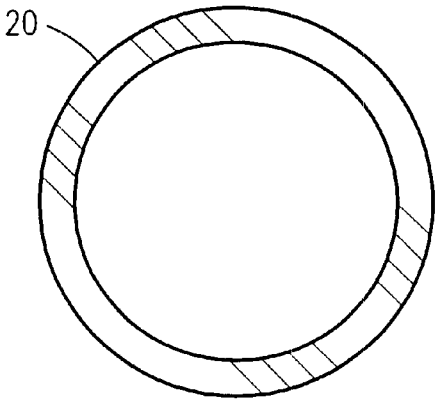
Figure 3:
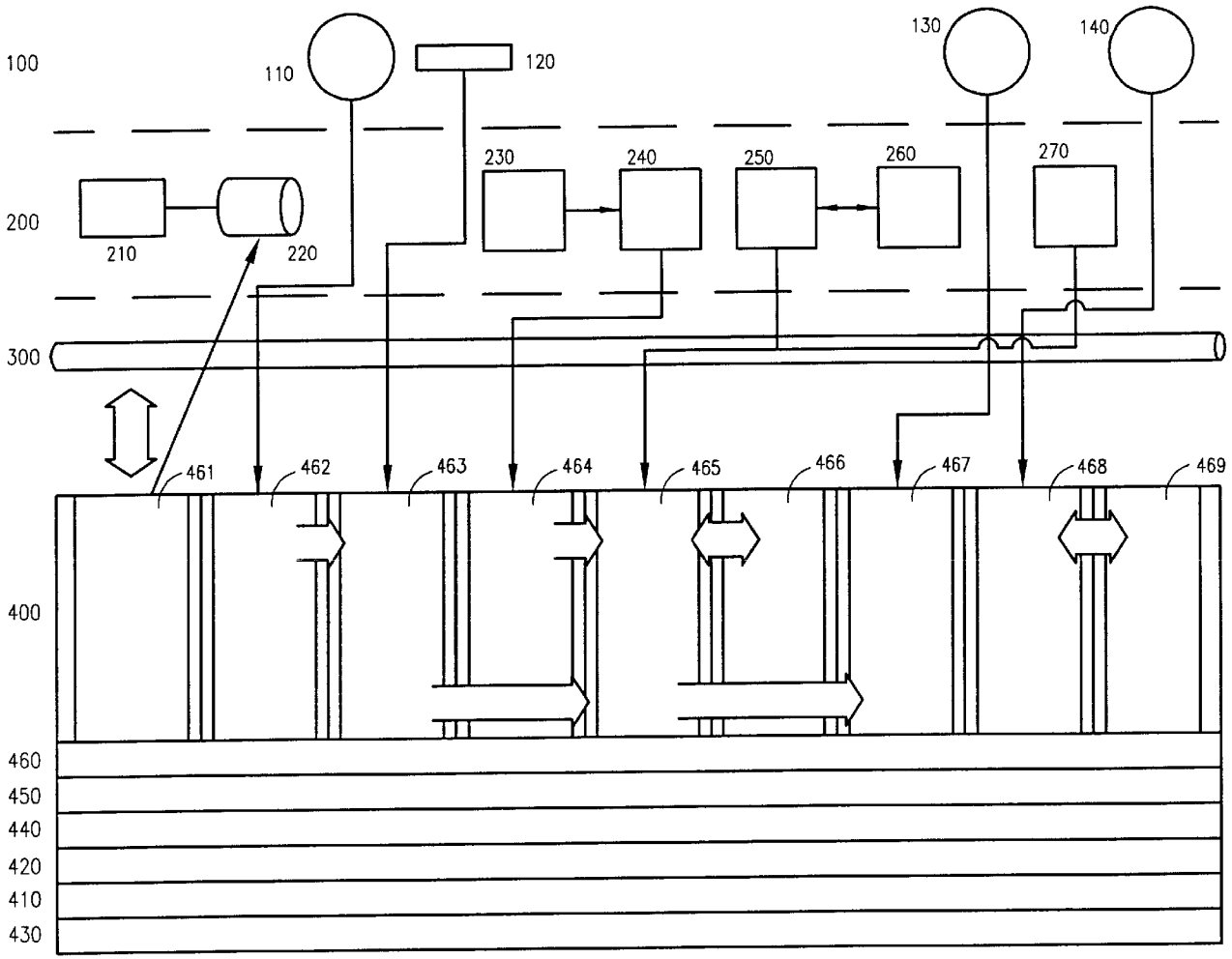
FIG. 3 illustrates a schematic depiction of the preferred embodiment of the personal security system shown in FIG. 1.

FIG. 1 depicts a system 10 for providing personal security to a user via event detection, according to one aspect of the invention. In this preferred embodiment, the system 10 is included in a wearable anklet device 20 and is worn at or near the ankle of the wearer. The system 10 may also be worn at or near the wrist of the wearer or at any other location on the body in which the system 10 contacts the skin of the wearer. FIGS. 2A and 2B depict the system 10 in a side view and a cutaway view, respectively. As seen in FIG. 3, the system 10 includes an external component level 100, an internal component level 200, a system bus 300, and a software component level 400. The external component level 100 is preferably embedded into the surface of the wearable anklet device 20. The wearable anklet device 20 or other such device may be weatherproof, shockproof, and "bodyproof," i.e., impervious to water, sweat, body heat, and physical punishment.

The external component level 100 may include an event sensor 110 for sensing a physiological event from the wearer. Preferably, the event sensor 110 is an electrogalvanic skin response sensor such as the MindDrive manufactured by The Other 90%, Inc. Electrogalvanic skin sensors use a technique called galvanic skin response (GSR); this technique measures the conductivity and electrical activity of the skin in order to sense physiological events. The MindDrive technology is capable of distinguishing between physiological signals generated by thoughts and signals generated by the autonomic nervous system. Although the preferred embodiment incorporates GSR, the event sensor 110 may be of any type that senses a physiological event generated by the wearer. The external component level 100 may also contain a manual entry input device 120, a feedback stimulator 130, and an input/output (I/O) port 140. In a preferred embodiment, the manual entry device 120 is a four-button, full logic keystrip allowing entry and interpretation of two different code sequences: one for manual initiation of a distress resolution process and one for canceling a distress resolution already in progress. The manual entry input device 120 may also be of any other type that allows manual initiation and cancellation of distress resolution processes. In a preferred embodiment, the feedback stimulator 130 generates a heat flash to notify the wearer that an emergency event has been sensed by the system 10. The feedback stimulator 130 may, however, be any device that notifies the wearer that notification of an emergency event has been received by an emergency management service (EMS). In a preferred embodiment, the I/O port 140 is an infrared device used to communicate with an external computer (not shown) in order to download a combination of data pertinent to the wearer and may include medical, behavioral, and physical data; however, the I/O port may be of any type that enables such communication.

The internal component level 200 may include a power generator 210 and an energy storage device 220 for generating and storing the energy used by the system, respectively. Preferably, the power generator 210 is a kinetic power supply such as the Seiko Kinetic power subsystem; however, any suitable power supply may be used. Preferably, the energy storage device 220 is a type of capacitive storage; however, any suitable energy storage device may be used. In one aspect, a long-life battery (not shown) may be used in place of the combination of the power generator 210 and energy storage device 220.

The internal component level 200 may also include a geographical positioning system antenna 230, a geographical positioning system device 240, a wireless communication transceiver device 250, a wireless communication transceiver antenna 260, and a voice synthesizer device 270. In one embodiment, the geographical positioning system device 240 is a Global Positioning System (GPS) chipset, such as the SiRF Star i/LX RF and DSP GPS chipsets; however, any suitable geographical positioning system may be used. Preferably, the wireless communication transceiver device 250 is a satellite communicator, such as the Kyocera transceiver currently used in Kyocera's satellite-only Iridium phone; however, any suitable transceiver device may be used. The voice synthesizer device 270 may be an analog-to-digital—digital-to-analog chipset such as that commonly used in an interactive voice response system (IVR); however, any suitable synthesizer device may be used to generate voice signal. Antennas used for the geographical positioning system antenna 230 and the wireless communication transceiver antenna 260 are well known in the art. The wearer's body could also serve as the antenna for communicating via the geographical positioning system device 240 and the wireless communication system device 250.

In a preferred embodiment, the system bus 300 is a printed circuit board as is well known in the art. The system bus 300 is used for communication between the external component level 100 and the software component level 400 and between the internal component level 200 and the software component level 100.

The software component level 400 may include a central processing unit (CPU) 410, a read-only memory (RAM) 420, and a random-access memory (RAM) 440. The CPU 410 may be a StrongARM or an Intel Pentium processor; however, any suitable processor may be used. The ROM 420 and RAM 440 may be of any known type.

As depicted in FIG. 3, a real-time operating system (RTOS) 450 and an application process component 460 may be running in the CPU 410 and utilizing the ROM 420 and RAM 440. The RTOS 450 is preferably a embedded Java Virtual Machine (JVM), such as the VxWorks made by WindRiver Systems; however, any suitable software operating system may be used.

In a preferred embodiment, the application process component 460 is an has several functions or "threads": a power management thread 461, a physiological feedback thread 462, a distress rules processing thread 463, a geographic location input handling thread 464, a distress message management thread 466, a heat flash indicator thread 467, a networking thread 468, and a configuration update thread 469.

In operation, the "bodyproof" anklet device 20 in which the system 10 is located is worn by a user. In order to operate the system 10, the components in the system 10 may receive energy from the energy storage device 220, which in turn may be powered by the power generator 210. For example, the power generator 210 may generate power from the motion of the wearer much like a self-winding watch is powered. The metering of energy to the system may be controlled by the power management thread 461.

Figure 4A:
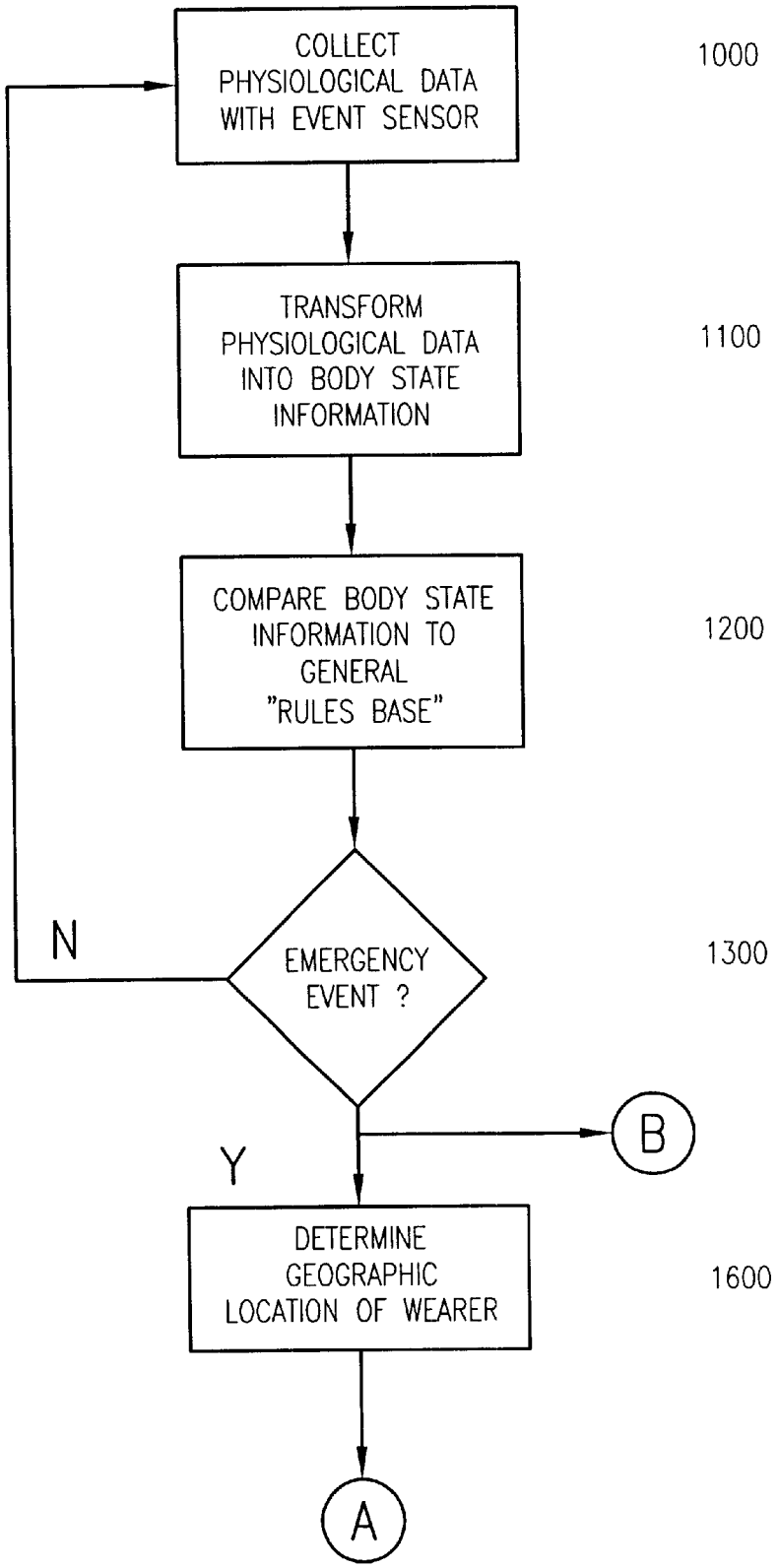
FIGS. 4A and 4B illustrate a flowchart of the preferred operation of the personal security system shown in FIG. 1.
Figure 4B:
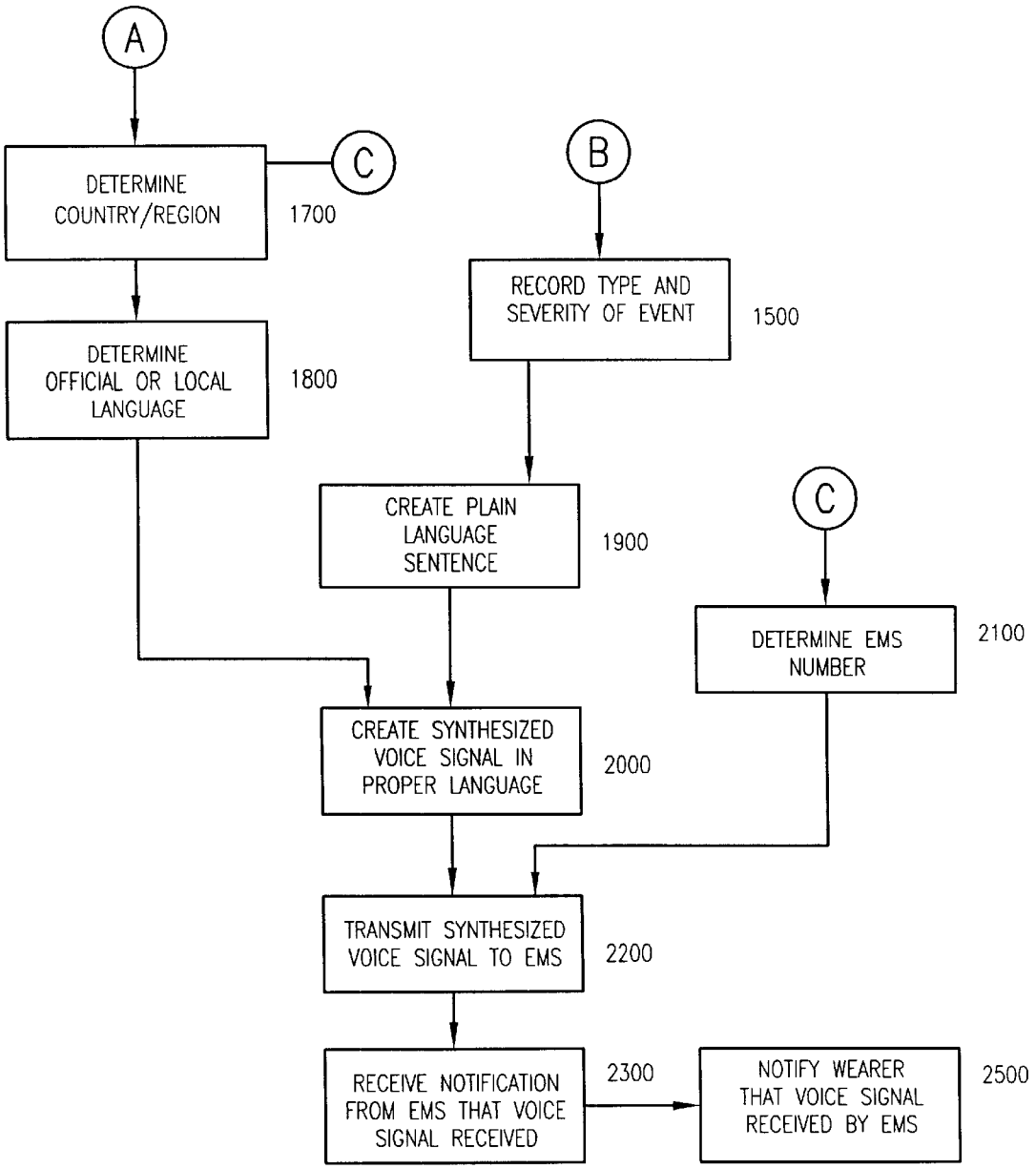

FIGS. 4A and 4B illustrate one aspect of the operation of the system in the presence of a detected event. Physiological data may be collected by the event sensor 110, as seen at step 1000. This physiological data may then be sent to the physiological feedback thread 462 for transforming the data into body state information, as seen at step 1100. The body state information may then be sent to the distress rules processing thread 463, as seen at step 1200; at this step, the body state information may be compared to a general "rules base" to enable decision making about the physiological data. For example, the system 10 may distinguish between the wearer experiencing a heart attack (i.e., the wearer's heartbeat has stopped) and the wearer experiencing an accident or a crime (i.e., the wearer's heartbeat has spiked). If an emergency event is detected, as seen at step 1300, information concerning the type and severity of the event may be sent to the distress message management thread, as seen at step 1500.

Information may also be sent to the geographic location input handling thread 464 concerning the existence of an emergency event by activating the geographic positioning system device 240 and the geographic positioning system antenna 230, as seen at step 1600. When the geographic location input handling thread 464 receives the geographic location of the wearer from the geographic positioning system device 240, a country/region lookup table may be accessed to determine what country or part of a country the wearer is located, as seen at step 1700. Once the geographic location of the wearer is determined, the geographic location handling thread 464 may determine an official or local language spoken in the geographic location, as seen at step 1800. Next, the geographic location handling thread 464 may send the geographic location of the wearer and the official or local language of that geographic location to the distress message management thread 465.

Once the distress message management thread 465 has received the type and severity of the event from the distress rules processing thread 463, these data may be converted into a plain language sentence, as seen at step 1900. The plain language sentence may then be sent to the voice processing thread 466 where it may be converted into a synthesized voice message using the voice synthesizer device 270 in the official or local language, as seen at step 2000. Based on the determination of the country/region, as seen at step 1700, a contact number for the local EMS is determined at step 2100. The contact number and the synthesized voice message may then be sent back to the distress message management thread 465 and then on to the wireless communication transceiver device 250 and the wireless communication transceiver antenna 260, as seen at step 2200. Of course, the plain language sentence may initially be created in the proper language.

When the synthesized voice message has been created, the system 10 may contact the local EMS at the appropriate contact number. When the EMS answers the call, the system 10 may begin speaking to a dispatcher at the EMS using a series of prompts and recognition of the dispatcher's speech in the manner of an interactive voice response system (IVR).

The wireless communication transceiver device 260 may then send a notification to the distress message management thread 465 indicating that the EMS has received the synthesized voice message, as seen at step 2300. Once the EMS has received notice of the emergency event, the distress message management thread 465 may then send a notification to the heat flash indicator thread 467 which may then send a signal to the feedback stimulator 130, as seen at step 2500. As discussed above, the feedback stimulator 130 may indicate to the wearer that the local EMS has been notified of the emergency event.

The system 10 will preferably come equipped with a default number of language sets and emergency numbers built in when purchased. The wearer may be able to configure the system 10 with a particular set (e.g., five) of languages and regions of travel (which the emergency numbers would correspond to) upon purchase. While the system 10 is worn, should the wearer pass from one language area to another, as detected by the geographical positioning system transceiver and antenna 240, 230, the proper language may be unloaded from the system's 10 ROM 420. Simultaneously, the system 10 may connect via the Internet (by TCP/IP) to a web server and download the language set and emergency numbers for the correct regional language. This connection via the Internet, of course, would not be necessary if the wearer moves to a new area whose language and emergency numbers are already loaded into the system 10.

The system 10 may also operate in a manual mode. In this mode, the wearer may depress a sequence of buttons on the manual entry device 120 indicating that the wearer is experiencing or observing an emergency event. In this situation, data from the manual entry device 120 may be sent directly to the distress rules processing thread 463, and processing may then proceed as discussed above beginning with step 1200.

In addition, the manual entry device 120 may be used to cancel the processing of an emergency event detected automatically or entered manually.

The system 10 may be used to hold a combination of data pertinent to the wearer and may include medical, behavioral, and physical data. These data may be downloaded into the system 10 upon the initial configuration of the system 10 or at any necessary time thereafter. These data may be loaded by connecting the I/O port 140 of the system 10 to an external computer database (not shown). The networking thread 468 may then be used to download medical data specific to the wearer from the external database to the system 10. Once the data are downloaded, they may be sent to the configuration update thread 469 to authenticate the data and apply the updates to the ROM 420 of the system 10. In one embodiment of the invention, these wearer-specific data may be transmitted to the EMS along with the transmission of emergency event information, as discussed above. These wearer-specific data may be converted to a plain language sentence and then to a synthesized voice signal in the proper language (these steps are not shown)—as was done with the emergency event data as shown in steps 1900 and 2000—or may be created directly in the proper language. Examples of wearer-specific data may be a type of medication taken by the wearer, an illness the wearer has, or other such information that would be relevant to an emergency care provider. An important example of wearer-specific data that could be sent to the EMS would be a list of drugs to which the wearer is allergic.

What is claimed is:

1. An apparatus for providing personal security to an individual comprising:

an event sensor;

a positioning system;

a message generation system, said message generation system connected to said event sensor and said positioning system, and generating an emergency message in an official language spoken in the geographic location; and a communication system, wherein said communication system communicates said emergency message to an emergency services provider.

2. The apparatus of claim 1, wherein said power system comprises a kinetic power generator and a power storage device.

3. The apparatus of claim 2, wherein said power system comprises a kinetic power generator and a power storage device.

4. The apparatus of claim 1, wherein said positioning system comprises a positioning system antenna and a positioning system chipset.

5. The apparatus of claim 1, wherein said communication system comprises a communication system antenna and a communication system chipset.

6. The apparatus of claim 1, wherein said positioning system comprises a Global Positioning System.

7. The apparatus of claim 1, wherein said message generation system generates said emergency message in an official language spoken in the geographic location.

8. The apparatus of claim 1, further comprising a database update port.

9. An apparatus for providing personal security to an individual comprising:

means for sensing an emergency event;

positioning means for detecting a geographic location of said emergency event;

means for generating an emergency message based on said emergency event and said geographic location, said message generating means including means for generating said emergency message in an official language spoken in said geographic location; and means for communicating said emergency message to an emergency services provider.

10. The apparatus of claim 9, wherein said event sensing means is an electrogalvanic sensor.

11. The apparatus of claim 10, wherein said powering means further comprises a means for generating kinetic power and means for storing power.

12. Tree apparatus of claim 9, wherein said event sensing means is an electrogalvanic sensor.

13. The apparatus of claim 9, wherein said positioning means further comprises a antenna and a transceiver.

14. The apparatus of claim 9, wherein said communicating means further comprises a antenna and a transceiver.

15. The apparatus of claim 9, wherein said positioning means is a Global Positioning System.

16. The apparatus of claim 9, further comprising means for allowing said individual to manually generate said emergency message.

17. A method for providing personal security to an individual comprising:

sensing an emergency event;

determining a geographic location of said emergency event;

generating an emergency message, said emergency message being based on said emergency event and said geographic location and being generated in an official language spoken in the geographic location; and transmitting said emergency message to an emergency services provider.

18. The method of claim 17, wherein said determining, generating, and transmitting comprises employing kinetic power.

19. The method of claim 17, wherein said sensing comprising an electrogalvanic sensor.

20. The method of claim 17, wherein said determining comprises employing a positioning system antenna and chipset.

21. The method of claim 17, wherein said transmitting comprises employing a communication system antenna and chipset.

22. The method of claim 17, wherein said determining comprises a Global Positioning System.

23. The method of claim 17, further comprising allowing said individual to manually generate and cancel said emergency message.

24. A method for providing personal security to an individual comprising the steps of:

sensing an emergency event;

determining a geographic location of said emergency event;

generating an emergency message, said emergency message being based on said emergency event and said geographic location, and being generated in an official language spoken in the geographic location; and transmitting said emergency message to an emergency services provider.

25. The method of claim 24, further comprising the step of providing power for said steps of determining, generating, and transmitting.

26. The method of claim 25, wherein said step of providing power comprises generating kinetic power and storing said power.

27. The method of claim 24, wherein said event sensing step comprises employing an electrogalvanic sensor.

28. The method of claim 24, wherein said determining step comprises employing a positioning system antenna and chipset.

29. The method of claim 24, wherein said transmitting step comprises a communication system antenna and chipset.

30. The method of claim 24, wherein said determining step comprises employing a Global Positioning System.

31. The method of claim 24, further comprising the step of allowing said individual to manually generate and cancel said emergency message.

* * * * *